US008002594B2

(12) United States Patent
Cheng

(10) Patent No.: US 8,002,594 B2
(45) Date of Patent: Aug. 23, 2011

(54) ELECTRICAL CONTACT FOR USE WITH LGA SOCKET CONNECTOR

(75) Inventor: Chih-Pi Cheng, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/795,674

(22) Filed: Jun. 8, 2010

(65) Prior Publication Data

US 2010/0311287 A1 Dec. 9, 2010

(51) Int. Cl.
*H01R 4/48* (2006.01)

(52) U.S. Cl. ..... 439/862

(58) Field of Classification Search ..... 439/862, 439/83, 81, 70

See application file for complete search history.

(56) References Cited

U.S. PATENT DOCUMENTS

| | | | | |
|---|---|---|---|---|
| 6,652,329 | B1 | 11/2003 | Howell et al. | |
| 6,905,377 | B2 * | 6/2005 | Murr | 439/862 |
| 7,264,486 | B2 * | 9/2007 | Ma | 439/83 |
| 7,534,113 | B2 * | 5/2009 | Liao et al. | 439/83 |
| 7,563,105 | B2 * | 7/2009 | Liu et al. | 439/66 |

* cited by examiner

*Primary Examiner* — Phuong K Dinh

(74) *Attorney, Agent, or Firm* — Andrew C. Cheng; Wei Te Chung; Ming Chieh Chang

(57) ABSTRACT

An electrical contact adapted for use in an electrical socket comprises a planar retaining body for being retained in the electrical socket, a soldering portion extending from a bottom end of the retaining body, and a resilient arm extending from a top end of the retaining body. The resilient arm comprises a first beam sloped upwardly and a second beam extending upwardly and reversely from the first beam. The first beam has a first angle with respect to a plane of the retaining body and a second angle with respect to another plane both perpendicular to the plane of the retaining body and a horizontal plane. The second beam has a contacting end at the top end thereof and toward the retaining body. An offset is defined between the contacting end of the resilient arm and the soldering portion.

11 Claims, 5 Drawing Sheets

ELECTRICAL CONTACT FOR USE WITH LGA SOCKET CONNECTOR

BACKGROUND OF THE INVENTION

1. Field of the Invention

The present invention relates to an electrical contact, and particularly to an electrical contact for use with a Land Grid Array (LGA) socket connector for electrically connecting a central process unit (CPU) and a printed circuit board (PCB), and the electrical contact is especially designed to have an offset spring arm carved directly from a carrier on which the electrical contact was stamped.

2. Description of Prior Art

In general, a LGA socket connector is used to connect a CPU to a PCB. Typically, the LGA socket connector includes an insulative housing and a plurality of electrical contacts received in the insulative housing. For example, U.S. Pat. No. 6,652,329 issued to David on Nov. 25, 2003 and U.S. Pat. No. 6,905,377 issued to MURR on Jun. 14, 2005 both disclose an LGA socket connector with a plurality of electrical contacts received therein. Each electrical contact comprises a retaining body for retaining the electrical contact to the insulative housing. A lower soldering portion extends from a bottom end of the retaining body for contacting the underside PCB. An upper contact beam extends from a top end of the retaining body with a contacting portion at free end thereof for contacting the upside printed circuit board.

Usually, the upper contact beam is about of C shape and the contact portion of the upper contact beam and the lower contact portion of the electrical contact are located at a same line in a vertical direction so as to establish an electrical connection between the CPU and the PCB. That needs a pad of the CPU and a pad of a PCB also are located at a same line in the vertical direction. Thus, the application area of the LGA socket connector with this type electrical contact is limited. This type LGA socket connector can not be used when the pad of the CPU is offset from the pad of the PCB.

Hence, an improved electrical contact for use in an LGA socket connector is required to overcome the disadvantages of the prior art.

SUMMARY OF THE INVENTION

A main object of the present invention is to provide an electrical contact for use in a LGA electrical socket connector, and the electrical contact is able to electrically connect a CPU and a PCB in which an offset is formed between a contacting pad thereof and a corresponding contacting pad of the CPU.

To fulfill the above-mentioned object, an electrical contact adapted for use in an electrical socket comprises a planar retaining body for being retained in the electrical socket, a soldering portion extending from a bottom end of the retaining body, and a resilient arm extending from a top end of the retaining body. The resilient arm comprises a first beam sloped upwardly and a second beam extending upwardly and reversely from the first beam. The first beam has a first angle with respect to a plane of the retaining body and a second angle with respect to another plane both perpendicular to the plane of the retaining body and a horizontal plane. The second beam has a contacting end at the top end thereof and toward the retaining body. An offset is defined between the contacting end of the resilient arm and the soldering portion.

Other features and advantages of the invention will become more apparent from the following detailed description of the present embodiment when taken in conjunction with the accompanying drawings.

DETAILED DESCRIPTION OF THE INVENTION

Figure 1:
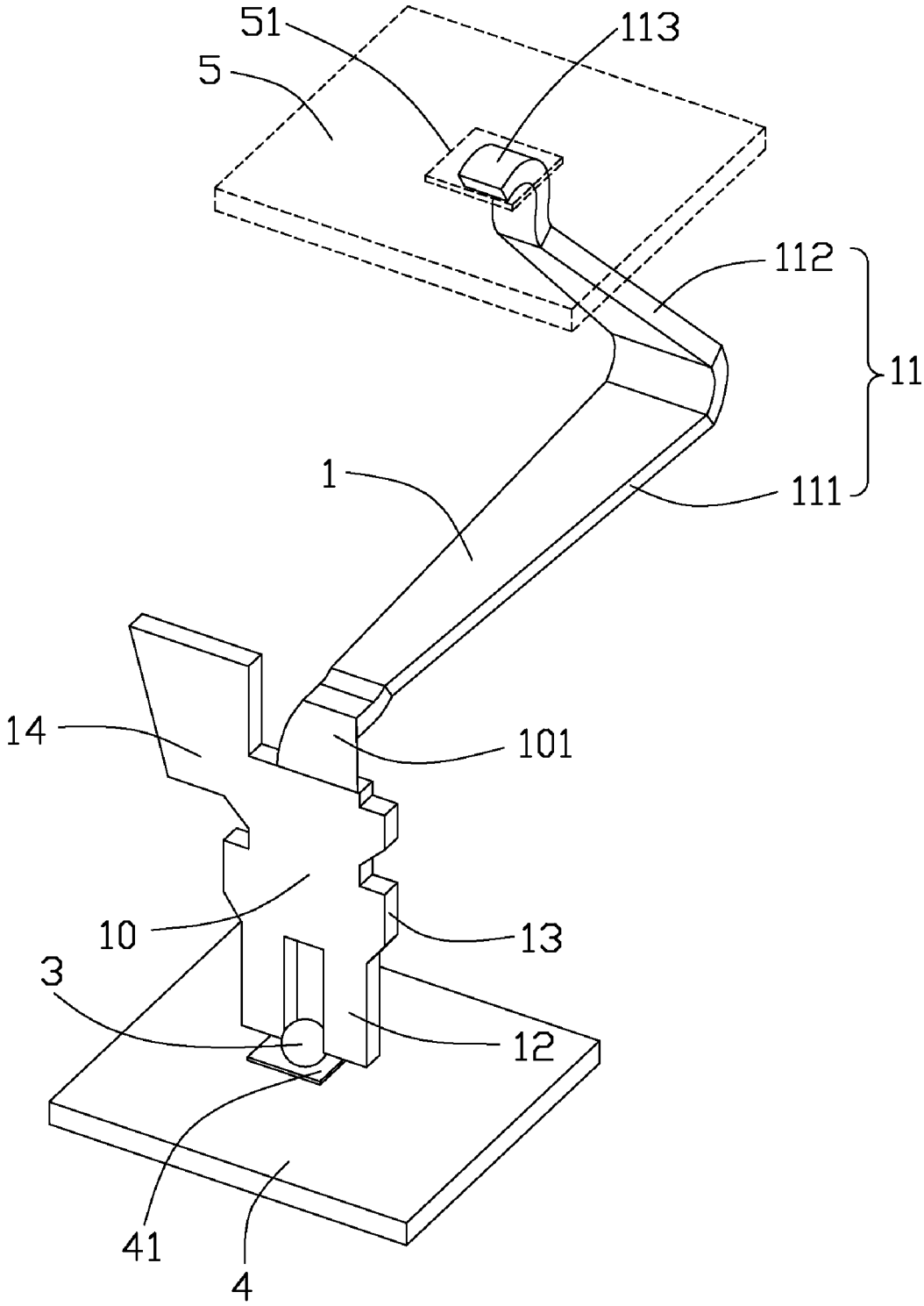
FIG. 1 is a perspective view of an electrical contact electrically connecting a CPU with a PCB in accordance with the present invention, in which a pad of the CPU and a pad of the PCB are shown in dotted line and a solder ball retained on the electrical contact is shown.

Reference will now be made to the drawing figures to describe the present invention in detail.

Figure 2:
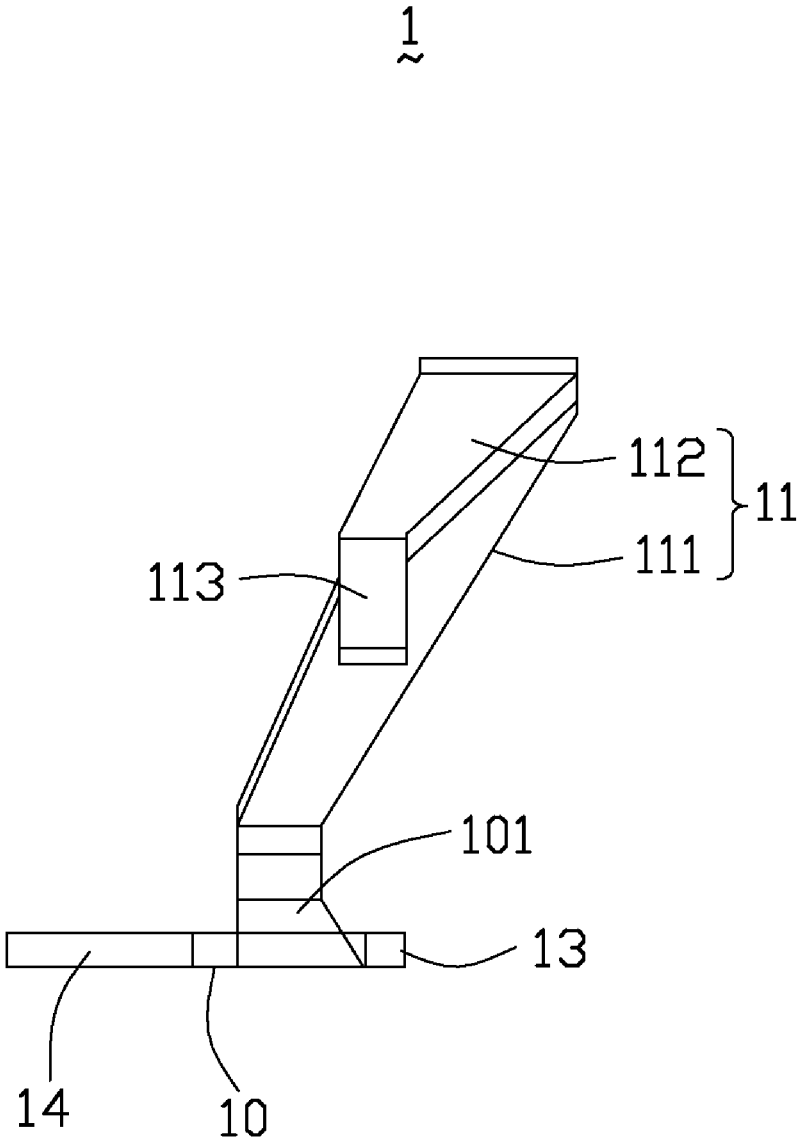
FIG. 2 is a top view of the electrical contact of FIG. 1.

Referring to FIGS. 1 and 2, a perspective view of an electrical contact 1 incorporating inventive features of the present invention is shown. The electrical contact 1 is used for an electrical socket connector, such as an LGA (Land Grid Array) socket connector, and electrically connects a CPU 5 and a printed circuit board 4. The electrical contact 1 comprises a planar retaining body 10, a resilient arm 11 extending from a top end of the retaining body 10, and a vertical soldering portion 12 extending from a bottom end of the retaining body 10 for retaining a soldering ball 3.

A deflected portion 101 is provided between the retaining body 10 and the resilient arm 11. The deflected portion 101 extends upwardly and forwardly from the top end of the planar retaining body 10. The resilient arm 11 substantially has a C-shaped configuration and extends from an upper end of the deflected portion 101. The resilient arm 11 comprises a first beam 111 gently upwardly and forwardly sloping from the top end of the deflected portion 101 and a second beam 112 extending reversely toward the retaining body 10 and upwardly inclining from a top end of the first beam 111.

Figure 3:
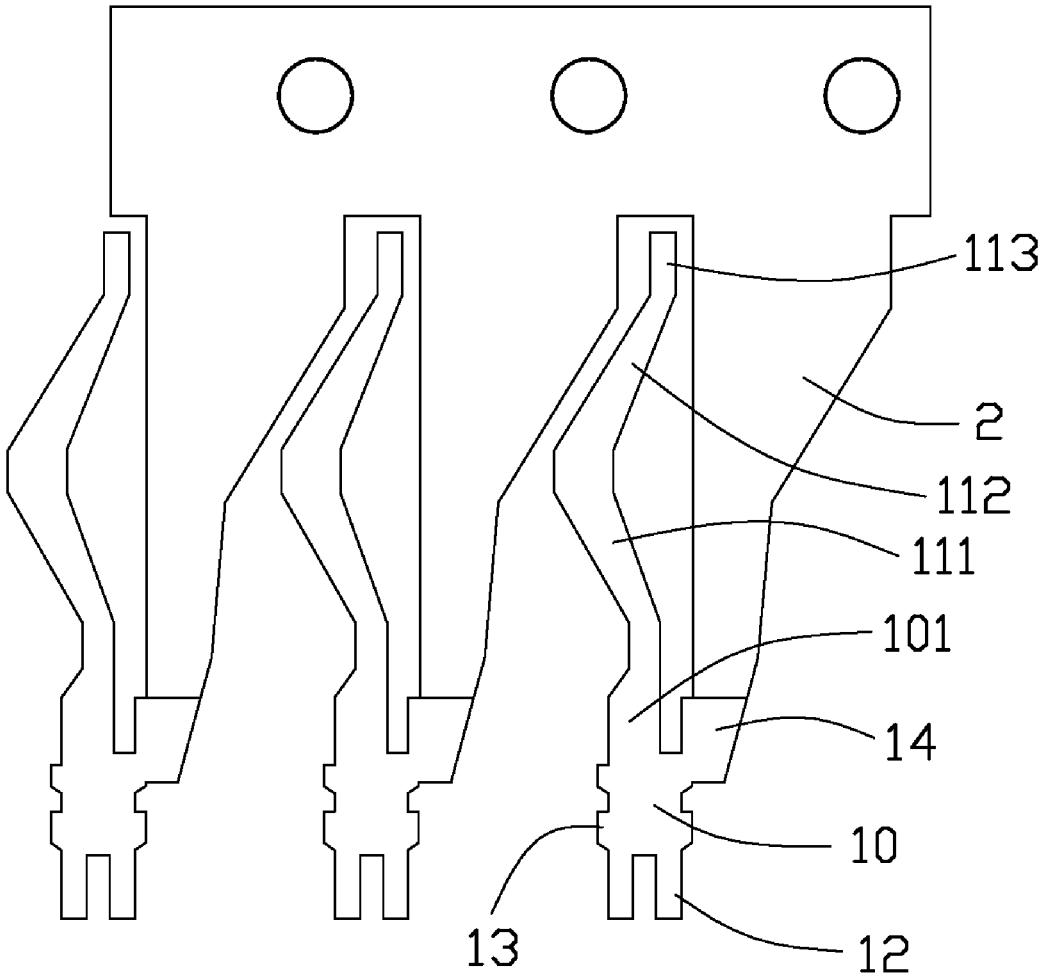
FIG. 3 is a plan view of the electrical contact connecting with a terminal material strip in a manufacturing process, showing a rough configuration of the electrical contact after stamping.
Figure 4:
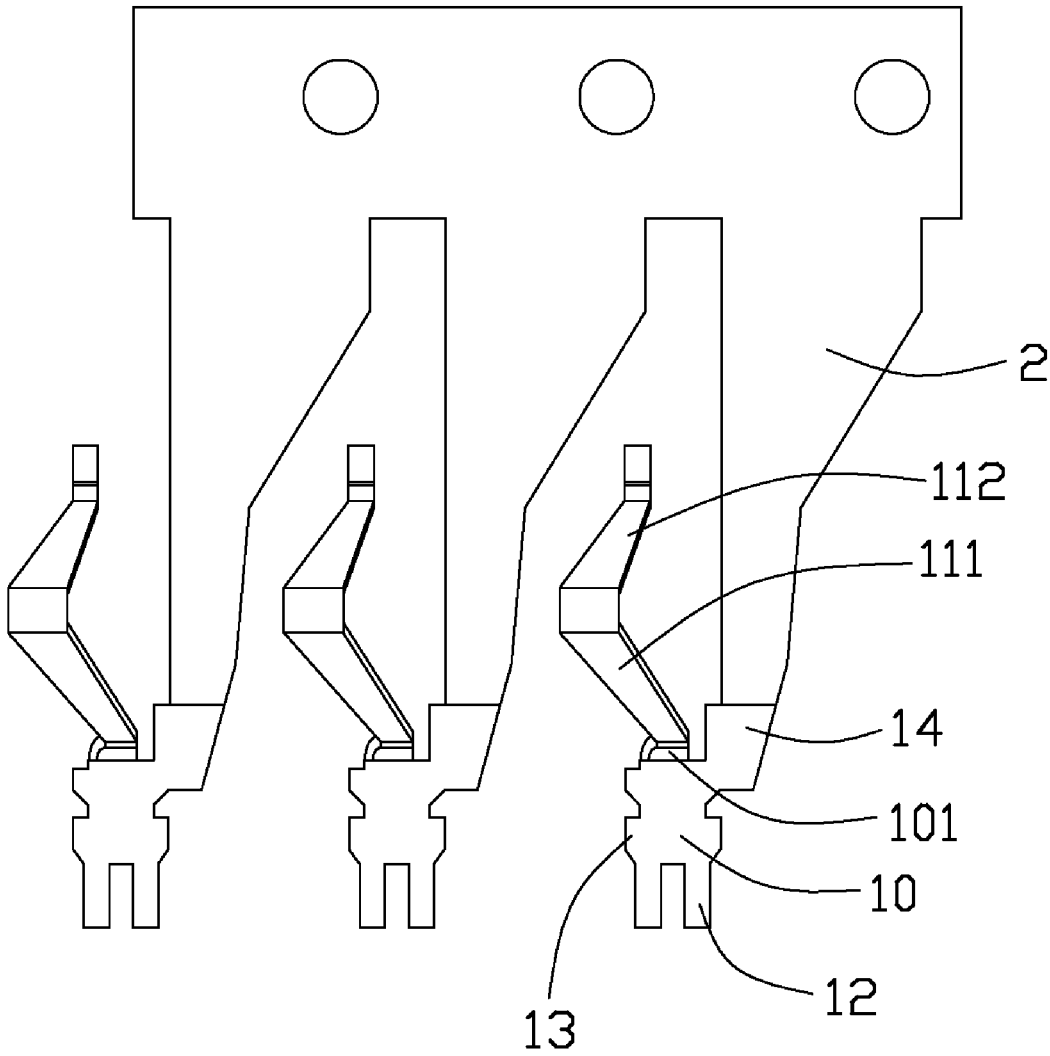
FIG. 4 is similar with FIG. 3, except that a resilient arm of the electrical contact is bent.
Figure 5:
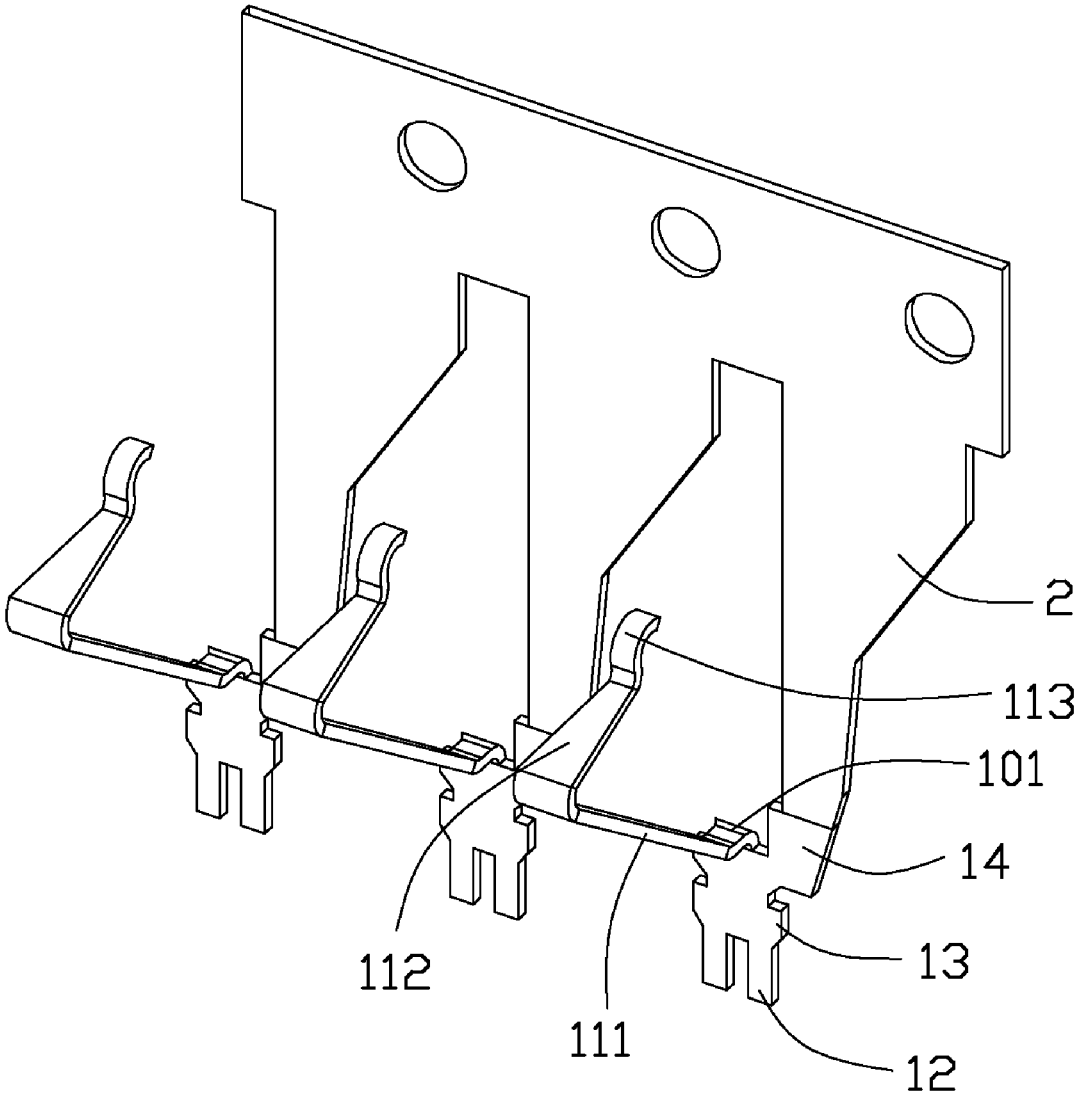
FIG. 5 is similar to FIG. 4, but from another side.

Referring to FIG. 3, showing a rough shape of the electrical contact 1, after the electrical contact 1 is stamped and before the resilient arm 11 is bent, the first beam 111 extends obliquely from the retaining body 10, while the second beam 112 reversely deflects from the top end of the first beam 111, so when the resilient arm 11 is bent to a final configuration, the first beam 111 has a first angle respect to a vertical plane of the retaining body 10 and a second angle respect to another plane both perpendicular to the plane of the retaining body 10 and a horizontal plane, respectively. Referring to FIGS. 4 and 5, the first beam 111 and the second beam 112 are designed asymmetrically. A length of the first beam 111 is longer than a length of the second beam 112. The second beam 112 has a curved contacting end 113 for contacting with a corresponding contacting pad 51 of the CPU 5. And the contacting end 113 is not disposed over the soldering portion 12. It means that an offset is formed between projections of the contacting end 113 and the soldering portion 12 on the horizontal plane. Thus, this electrical contact 1 can meet the requirement that the contacting pad 51 of the CPU 5 needs to contact with a corresponding contacting pad 41 of the PCB 4 which has an offset with the contacting pad 51 of the CPU 5.

The soldering portion 12 comprises a pair of retaining beams (not labeled) spaced to each other and extending downwardly for retaining the soldering ball 3. A plurality of barbs 13 are respectively provided on an opposite lateral sides of the retaining body 10 for fixing the electrical contact 1 in an insulative housing (not shown). A projecting portion 14 extends upwardly from one lateral side of the retaining body 10. The projecting portion 14 is located above the barbs 13 and in a parallel relation. The projecting portion 14 is used for connecting with a metal sheet 2 in manufacturing process of the electrical contact 1. And there is no need to additionally design a support body bent from the one lateral side of the retaining body 10 for connecting with the metal sheet 2. So, it can simply the structure of the electrical contact 1 and reduce the height of the electrical contact 1.

Referring to FIGS. 3 to 4, it illustrates a manufacturing process of the electrical contact 1. In order to form the electrical contact 1 in accordance with the present invention, firstly the flat metal sheet 2, preferably, a copper alloy sheet, is stamped to integrally form a number of blank electrical contacts 1 with the projecting portions 14 therein. The blank electrical contacts 1 and projecting portions 14 lie on the same flat plane as the metal sheet 2. Each electrical contact 1 comprises the retaining body 10, the soldering portion 12 at the bottom end of the retaining body 10, the resilient arm 11 located on the top side of the retaining body 10, and a number of barbs 13 at two opposite sides of the retaining body 10. And the deflected portion 101 is disposed between the retaining body 10 and the resilient arm 11. In stamping process, the resilient arm 11 is directly and obliquely carved from the metal sheet 2 according to a calculated shape. Both the deflected portion 101 and the resilient arm 11 are at a same plane with the retaining body 10. The first beam 111 and the second beam 112 are not at a same line. The first beam 111 extends obliquely and upwardly from the top end of the deflected portion 101 and an oblique angle is formed between the first beam 111 and the retaining body 10. The second beam 112 extends obliquely and upwardly from a top end of the first beam 111 and an obtuse angle is formed between the second beam 112 and the first beam 111. Thus, a semi-finished electrical contact 1 is formed as shown in FIG. 3.

Then, the semi-finished electrical contact 1 together with the metal sheet 2 is thereafter subjected to a bending operation. As shown in details in FIGS. 4 to 5, the deflected portions 101 are bent toward to one side of the retaining body 10. The resilient arm 11 is bent to form C-shape. The contacting end 113 of the resilient arm 11 is bent upwardly and toward the metal sheet 2. Thus the electrical contact 1 has an offset spring arm 11 to electrically connecting the CPU 5 and the PCB 4 when the pad 51 of the CPU 5 is offset from the pad 41 of the PCB 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical contact adapted for use in an electrical socket comprising:

a planar retaining body for being retained in the electrical socket and located in a vertical plane;

a soldering portion extending from a bottom end of the retaining body;

a resilient arm extending from a top end of the retaining body, the resilient arm comprising a first beam sloped upwardly and a second beam extending upwardly and reversely from the first beam, the first beam having a first angle with respect to a plane of the retaining body and forming a second angle with respect to another plane both perpendicular to the plane of the retaining body and a horizontal plane, the second beam having a contacting end at the top end thereof and toward the retaining body, an offset is defined between the contacting end of the resilient arm and the soldering portion, wherein the soldering portion comprises a pair of retaining beams extending vertically and downwardly from the bottom end of the retaining body, wherein the pair of retaining beams of the soldering portion is spaced to each other and adapted to retain a soldering ball, wherein a projecting portion extends upwardly from one lateral side of the retaining body for connecting with a metal sheet, wherein the retaining body is formed with a plurality of barbs on opposite lateral sides thereof, wherein the projecting portion is located above the barbs and in a parallel relation.

2. The electrical contact as claimed in claim 1, wherein when the electrical contact is stretched in a planar plane, an oblique angle is formed between the first beam and the retaining body.

3. The electrical contact as claimed in claim 1, wherein a deflected portion is provided between the retaining body and the resilient arm, the deflected portion extends upwardly and forwardly from the top end of the retaining body.

4. The electrical contact as claimed in claim 3, wherein the first beam of the resilient arm extends upwardly and obliquely from the top end of the deflected portion.

5. The electrical contact as claimed in claim 4, wherein the first beam and the second beam are unsymmetrical and a length of the first beam is longer than a length of the second beam.

6. An electrical contact adapted for use in an electrical socket comprising:

a retaining body for being retained in the electrical socket;

a soldering portion extending from a bottom end of the retaining body;

a resilient arm extending from a top end of the retaining body, the resilient arm comprising a first beam gently upwardly and forwardly sloping from the top end of the retaining body and a second beam extending reversely toward the retaining body and upwardly inclining from a top end of the first beam; wherein when the electrical contact is stretched, the first beam and the second beam of the resilient arm are in a same plane but dose not extend in a same line, an oblique angle is formed between the first beam and the retaining body, wherein the soldering portion comprises a pair of retaining beams extending vertically and downwardly from the bottom end of the retaining body, wherein the pair of retaining beams of the soldering portion is spaced to each other and adapted to retain a soldering ball, wherein a projecting portion extends upwardly from one lateral side of the retaining body for connecting with a metal sheet, wherein the retaining body is formed with a plurality of barbs on opposite lateral sides thereof, wherein the projecting portion is located above the barbs and in a parallel relation.

7. The electrical contact as claimed in claim 6, wherein an obtuse angle is formed between the second beam and the first beam.

8. The electrical contact as claimed in claim 6, wherein a deflected portion is provided between the retaining body and the resilient arm, the deflected portion extends upwardly and forwardly from the top end of the retaining body.

9. The electrical contact as claimed in claim 6, wherein a projecting portion extends upwardly from one lateral side of the retaining body for connecting with a metal sheet.

10. The electrical contact as claimed in claim 6, wherein the second beam has a contacting end at a top end thereof, an offset is defined between the resilient arm and the soldering portion.

11. A contact assembly including:

a contact carrier;

a plurality of contacts linked to the contact carrier along a longitudinal direction;

each of said contacts including a planar retaining body with a lower soldering portion at a bottom area thereof, a projecting portion and a resilient arm side by side extending respectively from a top area thereof, said resilient arm defining upper and lower beams commonly defining a generally "<" like configuration in a front view wherein the lower beam is essentially connected to the retaining body and the upper beam is connected to the lower beam under condition that said upper beam and said lower beam are originally symmetrically arranged with each other in an extended manner so as to have a tip of the upper beam and the root of the lower beam essentially located in a same vertical line, while being asymmetrically arranged with each other after deflected toward a same side of the retaining body in a transverse direction perpendicular to said longitudinal direction essentially via a horizontal line which divides said upper beam and said lower beam with two different lengths so as to have the upper tip of the upper beam offset from the root of the lower beam in both said longitudinal direction and said transverse direction, wherein the soldering portion comprises a pair of retaining beams extending vertically and downwardly from the bottom end of the retaining body, wherein the pair of retaining beams of the soldering portion is spaced to each other and adapted to retain a soldering ball, wherein a projecting portion extends upwardly from one lateral side of the retaining body for connecting with a metal sheet, wherein the retaining body is formed with a plurality of barbs on opposite lateral sides thereof, wherein the projecting portion is located above the barbs and in a parallel relation.

* * * * *